US007966960B2

(12) United States Patent
Linares

(10) Patent No.: US 7,966,960 B2
(45) Date of Patent: Jun. 28, 2011

(54) PLASTICIZED AND ASSEMBLEABLE COVER SUCH AS FOR USE WITH WATERWAY CONSTRUCTED TRANSPORT BARGES

(75) Inventor: Miguel Linares, Bloomfield Hills, MI (US)

(73) Assignee: Brown Water Plastics, LLC, Paducah, KY (US)

( * ) Notice: Subject to any disclaimer, the term of this patent is extended or adjusted under 35 U.S.C. 154(b) by 315 days.

(21) Appl. No.: 12/187,677

(22) Filed: Aug. 7, 2008

(65) Prior Publication Data

US 2009/0038524 A1 Feb. 12, 2009

Related U.S. Application Data

(60) Provisional application No. 60/954,487, filed on Aug. 7, 2007.

(51) Int. Cl.
*B63B 19/12* (2006.01)

(52) U.S. Cl. ..... 114/201 R

(58) Field of Classification Search ..... 114/201 R, 114/202, 203
See application file for complete search history.

(56) References Cited

U.S. PATENT DOCUMENTS

| | | | | |
|---|---|---|---|---|
| 3,730,128 | A | 5/1973 | Burwell | |
| 3,785,322 | A * | 1/1974 | Kersteter | 114/201 R |
| 3,800,723 | A | 4/1974 | Collins | |
| 4,130,125 | A | 12/1978 | Nivin | |
| 4,237,809 | A | 12/1980 | Hickmann | |
| 4,239,008 | A * | 12/1980 | Conlon | 114/201 R |
| 4,461,232 | A | 7/1984 | Berg | |
| 4,537,147 | A | 8/1985 | Nivin | |
| 5,322,405 | A * | 6/1994 | Swensson et al. | 114/201 R |
| 5,380,058 | A | 1/1995 | Short et al. | |
| 5,778,815 | A | 7/1998 | Shields et al. | |
| 5,850,799 | A | 12/1998 | Geisel et al. | |
| 5,931,111 | A | 8/1999 | Shields et al. | |
| 6,016,761 | A | 1/2000 | Berg, Sr. | |
| 6,109,283 | A | 8/2000 | Burke et al. | |
| 6,138,597 | A | 10/2000 | Berg, Sr. | |
| 6,161,493 | A | 12/2000 | Berg, Sr. | |
| 6,352,046 | B1 | 3/2002 | Berg, Sr. et al. | |
| 6,443,084 | B1 | 9/2002 | Berg, Sr. et al. | |
| 6,516,740 | B2 | 2/2003 | Berg, Sr. et al. | |

FOREIGN PATENT DOCUMENTS

| | | | |
|---|---|---|---|
| JP | 55094877 | A | 7/1980 |
| JP | 62214087 | A | 9/1987 |

* cited by examiner

*Primary Examiner* — Lars A Olson
(74) *Attorney, Agent, or Firm* — Gifford, Krass, Sprinkle, Anderson & Citkowski, P.C.

(57) ABSTRACT

A cover for use with an elongated opening associated with a transportable barge. The cover includes a number of inter-engageable cover sections, each exhibiting a lightweight plasticized construction and extending in both widthwise and lengthwise fashion relative to an upper lip edge defining an open perimeter of the barge. Each cover section exhibits pairs of opposing lifting eyes and associated locking pins, these being defined along outer extending side edge locations of each cover section and is adapted to securing the cover section upon the barge perimeter defining edge. At least one roller supported and traversable door is incorporated into each cover section and defines a selectively open location for accessing a cargo carrying interior associated with the barge.

17 Claims, 12 Drawing Sheets

PLASTICIZED AND ASSEMBLEABLE COVER SUCH AS FOR USE WITH WATERWAY CONSTRUCTED TRANSPORT BARGES

CROSS-REFERENCE TO RELATED APPLICATIONS

This Application is a Non-Prov of Prov (35 USC 119(e)) application 60/954,487 filed on Aug. 7, 2007 and entitled Plasticized and Assembleable Cover Such as for Use with Waterway Constructed Transport Barges.

FIELD OF THE INVENTION

The present inventions collectively disclose a multi-piece, plasticized, and buoyant cover for use with a waterway transport barge, and such as in particular a hopper barge carrying large volumes of loose granular materials, such as fertilizers, grains and the like. Assemble able components define a plurality of individual and alternating (i.e., male/female/end) lid sections associated with a conventional sized transport barge, these further being aerodynamically constructed, ventilated and stackable. Additional features associated with the design include such as textured/non-slip surfaces and integrally defined stairways leading to roller supported and slidable access doors.

BACKGROUND OF TIE INVENTION

The prior art is well documented with examples of barge cover assemblies. An objective of known cover assemblies is to protect items carried within a cavity defined body of a transport barge supported upon a body of water.

An objective of such barge covers is to enable them to be more easily lifted off from the an open perimeter defining location established by the barge. One example of a such a hopper barge cover is disclosed in U.S. Pat. No. 4,237,809, issued to Hickmann, and which includes a plurality of linearly telescoping cover portions (housings), terminating in a central most and highest housing (i.e., both ends displace progressively inwards to a central location). The central housing exhibits a transverse plate extending across it at the center of its length. The outermost housing is driven at each end separately with the other housings having cooperating elements to engage each other to cause the housings on each side of the transverse plate of the central housing to sequentially move in or out with respect to the central housing. All of the housings have glides or wheels on each side for riding on flat surfaces supported on opposing sides of the barge.

Geisel, U.S. Pat. No. 5,850,799, teaches a portable barge cover incorporating a removable and storable covering system including several overlapping flexible sheets places over spaced apart arched members and which span from one side of a hold to the opposite side. The flexible sheets are secured by several straps that cross over the flexible sheets trapping the sheet between the strap and the arched member.

U.S. Pat. Nos. 6,016,761, 6,138,597 and 6,161,493, to Berg, Sr., each disclose a lift-off cover assembly for barges which includes adjacently positioned and curved cover sections and end cover sections located at opposite ends of the adjacently positioned curved cover sections. The cover assembly includes a central walkway which extends between openings on the cover assembly and climbing stairs which are positioned so as to facilitate the travel of a cargo loading operated towards the openings. Each of the openings further includes cover members, such as lids or doors, which have handles or latches that are accessible from the central walkway.

Finally, additional U.S. Pat. Nos. 6,352,046 and 6,443,084, also to Berg, Sr., each disclose a variation of a telescoping and rolling cover assembly for a barge and which includes a plurality of cover sections, such as constructed of fiber reinforced plastic, and which travel along a track or tracks provided upon an associated barge coaming. The cover sections are provided with anti-derailment tracks that engage a vertical lip of the barge coaming to prevent the covers from being pulled off the track. The clamps are further provided with wind latch extensions to secure the cover sections in a stacked position. The cover sections may be provided with a stacking shelf that provides a surface on which an overlying stacked cover may rest, and may further travel along one or more tracks provided o the sides of the barge coaming. A portion of some cover sections may travel along tracks attached to underlying cover sections.

SUMMARY OF THE INVENTION

The present invention discloses an improved cover for use with an elongated opening associated with a transportable barge, and includes a number of inter-engageable cover sections, each exhibiting a lightweight plasticized construction and extending in both widthwise and lengthwise fashion relative to an upper lip edge defining an open perimeter of the barge. Each cover section exhibits pairs of opposing lifting eyes and associated locking pins, these being defined along outer extending side edge locations of each cover section and is adapted to securing the cover section upon the barge perimeter defining edge.

At least one roller supported and traversable door is incorporated into each cover section and defines a selectively open location for accessing a cargo carrying interior associated with the barge. Additional features include the cover sections being provided as first and second end sections, with intermediately defined and alternating female and male sections arranged in joint abutting fashion between opposite ends of barge perimeter opening, with the end walls associated with each end section sealed and bolted to associated end wall joints. A ladder is secured in vertically extending fashion along a selected end wall section and to assist in gaining access to a top surface of the cover.

The cover sections further each exhibit a specified shape and size with an arcuate extending upper edge into which is integrally formed a stairway leading to the roller supported door. In a preferred variant, each cover section includes a pair of roller supported doors and integrally defined stairways extending in opposing and lengthwise spaced apart fashion from first and second sides. Each of the doors further includes respective pluralities of door supporting and track supporting rollers, mating grooves and ridges established between the door and cover section facilitating displacement of the door between opened and closed positions and both front and rear locking portions associated with the door facilitate supporting the door in the opened and closed positions.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
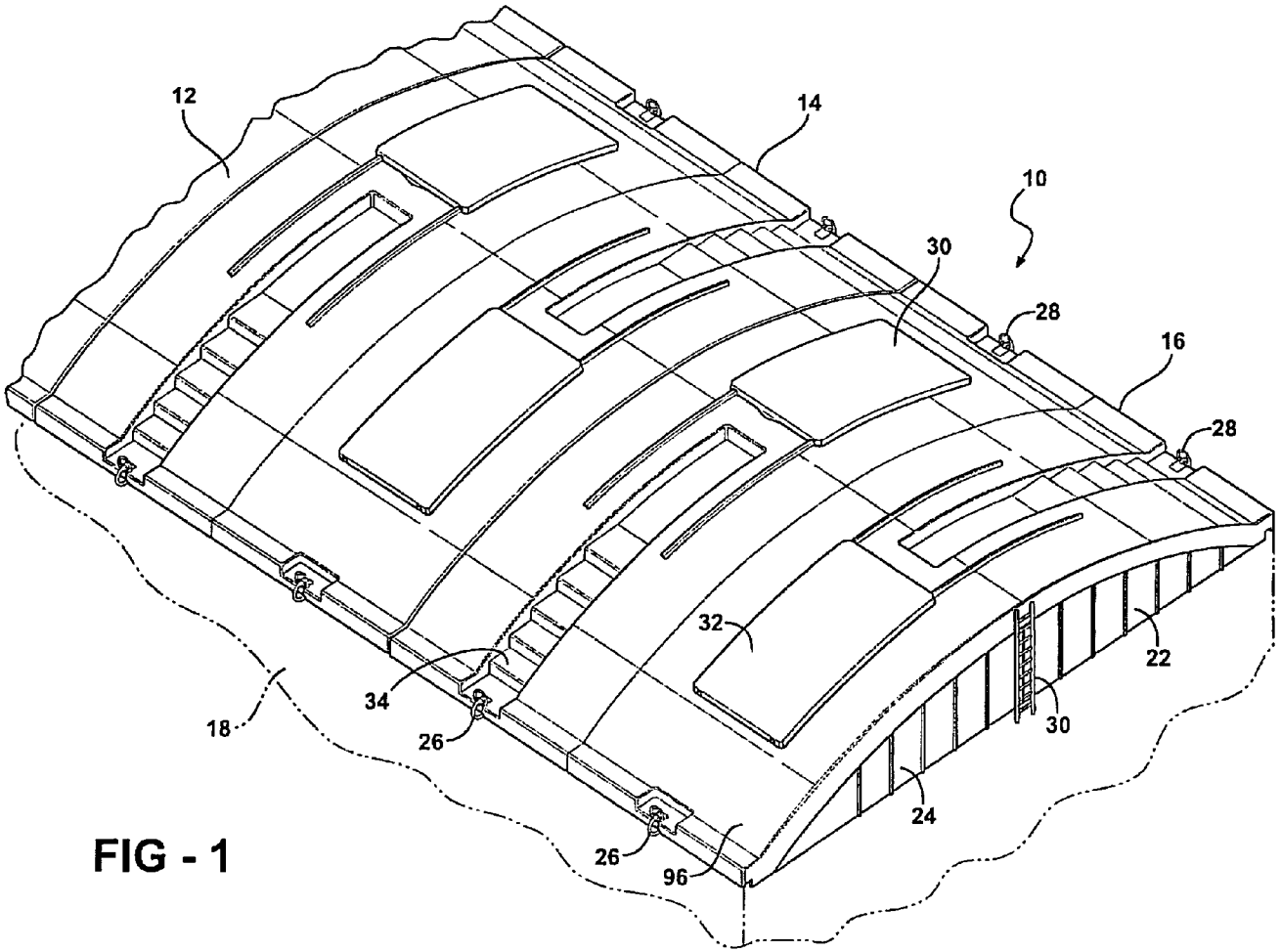
FIG. 1 is a perspective view of the assembleable cover and illustrating a sub-plurality of male, female and end sections which are secured over an open top of a conventional waterway transportable barge.

Referring now to the drawing illustrations, a series of perspective, plan and cutaway views are shown of a multi-piece, plasticized, and buoyant cover for use with a waterway transport barge, and such as in particular a hopper barge carrying large volumes of loose granular materials, such as fertilizers, grains and the like.

As will further be described, the assembleable components define a plurality of individual and alternating (i.e., male/female/end) lid sections, these associated with a conventional sized transport barge. The lid/cover sections are aerodynamically constructed from such as typically a recyclable, lightweight plastic and/or powder impression formed material (incorporating such as an entrained aggregate material of desired composition). The construction of each section is such that it exhibits buoyant characteristics when placed within a body of water and, when assembled in place over an associated defined inner perimeter and coaming associated with the cargo containing barge, exhibits both inner-ventilating and moisture impervious aspects for the transport barge.

As will also be described, each cover section further includes one or more slidable/roller supporting doors. Additional features associated with the design also include such as textured/non-slip surfaces, integrally defined stairways leading to the roller supported and slidable access doors, and pairs of side disposed lifting eyes. The lifting eyes, in combination with rotatably displaceable engaging pins associated with an upper lip edge location of the cover, allow a given cover section to be engaged and removed by a crane.

Referring again to FIG. 1, a perspective view is shown generally at 10 of the assembleable cover and illustrates a sub-plurality of male 12, female 14 and end 16 defined sections, these being interengaged together and secured over an open perimeter defined top (the associated inner coaming edge of which is not illustrated) of a conventional waterway transportable barge 18. Although not shown, it is understood that a plurality of such as nine (9) sections, consisting such as of end/female/male/female/male/female/male/female/end cover sections are arranged in lengthwise extending and interlocking fashion for spanning a distance associated with the conventional waterway transport barge 18.

It is further understood that any other plurality of cover sections can be employed, such as ranging downward to a single section for covering a smaller sized perimeter opening of a likewise smaller sized barge or other smaller sized shipping container. The selected cover section or sections each exhibit specified length and width defining characteristics with the defined perimeter opening of the barge or container opening.

Although the barge is only illustrated representatively in certain illustrations, such as again at 18 in FIG. 1, it is understood that a variant of the present invention operates with a conventional hopper barge, approximately 175' feet in overall length and 35' in width, and particularly suited for transporting upon waterways such as loose granulate cargoes including fertilizers, grains and the like. That said, it is understood that the barge cover is capable of being employed with any open topped and three-dimensional cargo carrying body, this including land freight (e.g. train and truck) enclosures, as well as potentially air freight enclosures.

Figure 2:
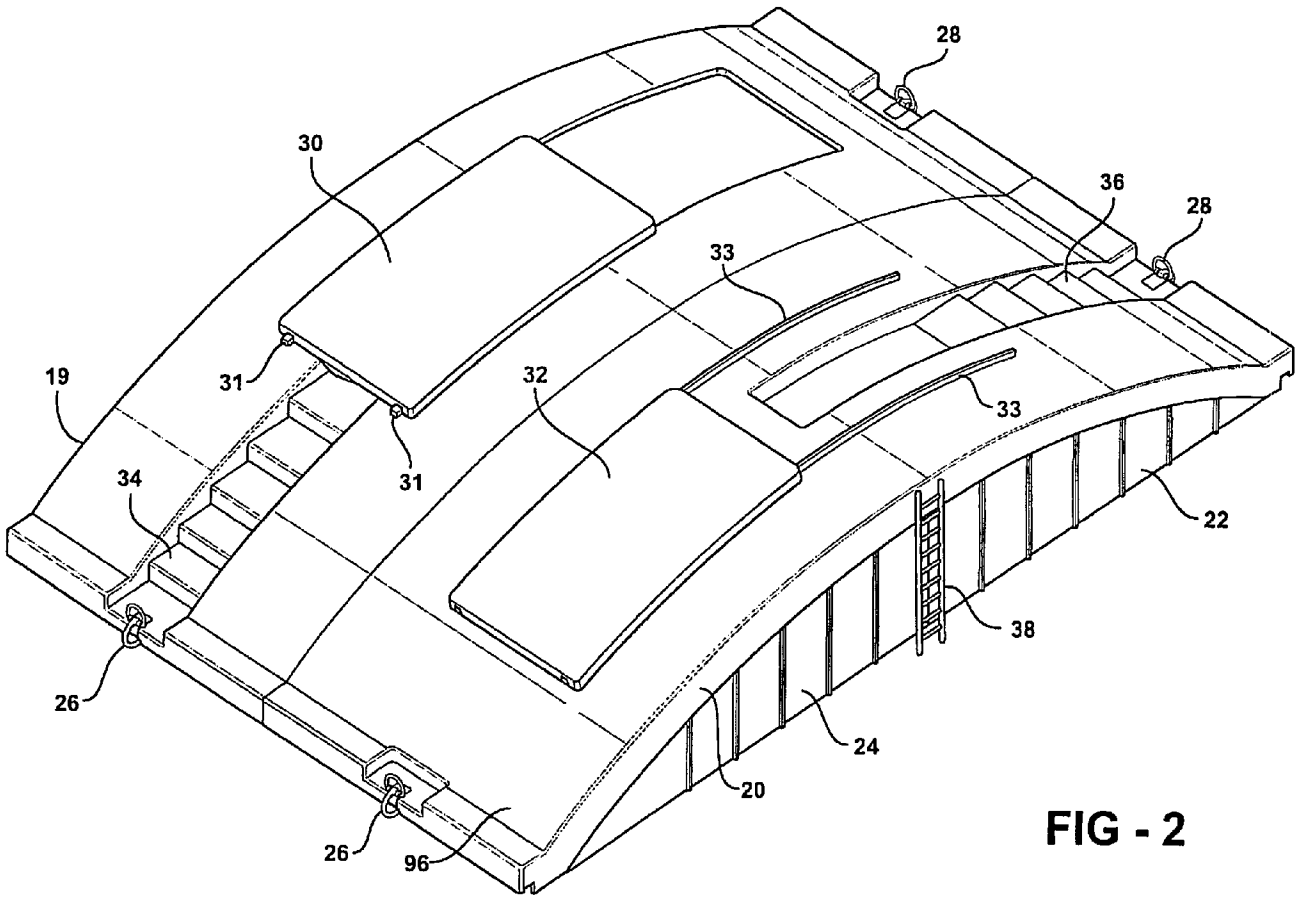
FIG. 2 is a rotated perspective view of a selected end (lid) section of the assembleable cover illustrated in FIG. 1.
Figure 7:
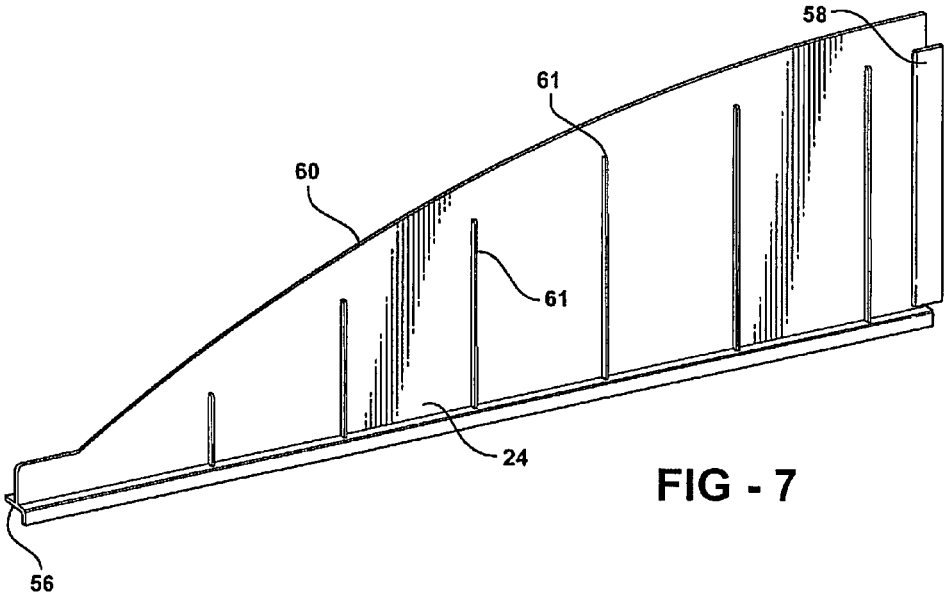
FIG. 7 an illustration of a ½ section of an end wall enclosing portion also shown in each of FIGS. 1 and 2.

Referencing FIG. 2, a rotated perspective view of a selected end (lid) section is again shown at 16 and includes an arcuate extending body with a first widthwise extending edge 19 (this interconnecting with an opposing and adjoining edge associated with the female cover portion 14 shown in FIG. 1) as well as a second opposite widthwise extending edge 20. An end wall encloses an open underside revealed by the edge 20, and relative to an end-extending supporting wall of the barge or other suitable cargo carrying article. As will also be illustrated in further detail in FIG. 7, the end wall includes a pair 22 and 24 of substantially three-sided (considering the upper arcuate edge as defining a single side) vertically disposed and interconnecting semi-sections, or portions, which are configured as shown in FIG. 2.

Additional features include first and second pairs 26 and 28 of opposite end extending eyelet portion, or lifting eyes, (see also FIG. 13) these being likewise provided along opposite extending edges associated with each interconnecting cover section and which, as will be further described, operate to facilitate release of engagement of the associated cover section with the associated lip (coaming) edge of the barge 18 and subsequent lifting/removal of that section from atop the barge. Yet additional features shown in FIG. 2 include a pair 30 and 32 arcuately configured, widthwise traversable and openable/closable roller supported doors, these being accessible by integrally configured stairs, see further at 34 and 36, (these established by integrally formed series of angled interconnecting surfaces defining a stairway leading to said door) and respectively, formed into the body of each cover section and (as will be further described in additional detail in reference to succeeding figures) facilitates access to the interior of the barge when the cover sections are secured in place. As with the lifting eyes 26 and 28, pairs of roller supported doors are illustrated in reference to each of the male, female and end sections shown in FIG. 1, it further being understood that additional variants contemplate selected cover sections either not exhibiting an openable door or having a single door.

Figure 3:
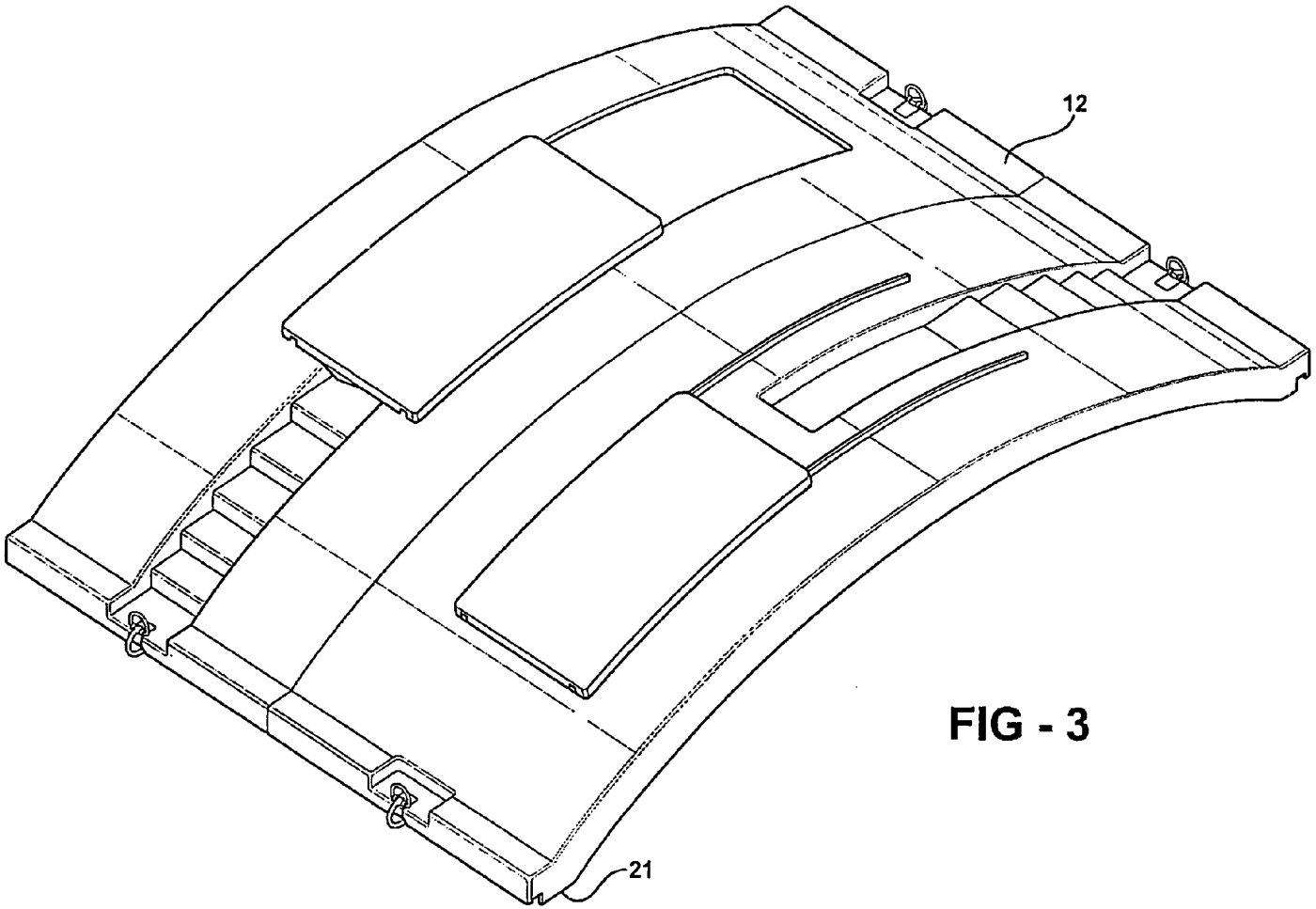
FIG. 3 is a rotated perspective view of a selected male lid section of the assembleable cover illustrated in FIG. 1.
Figure 4:
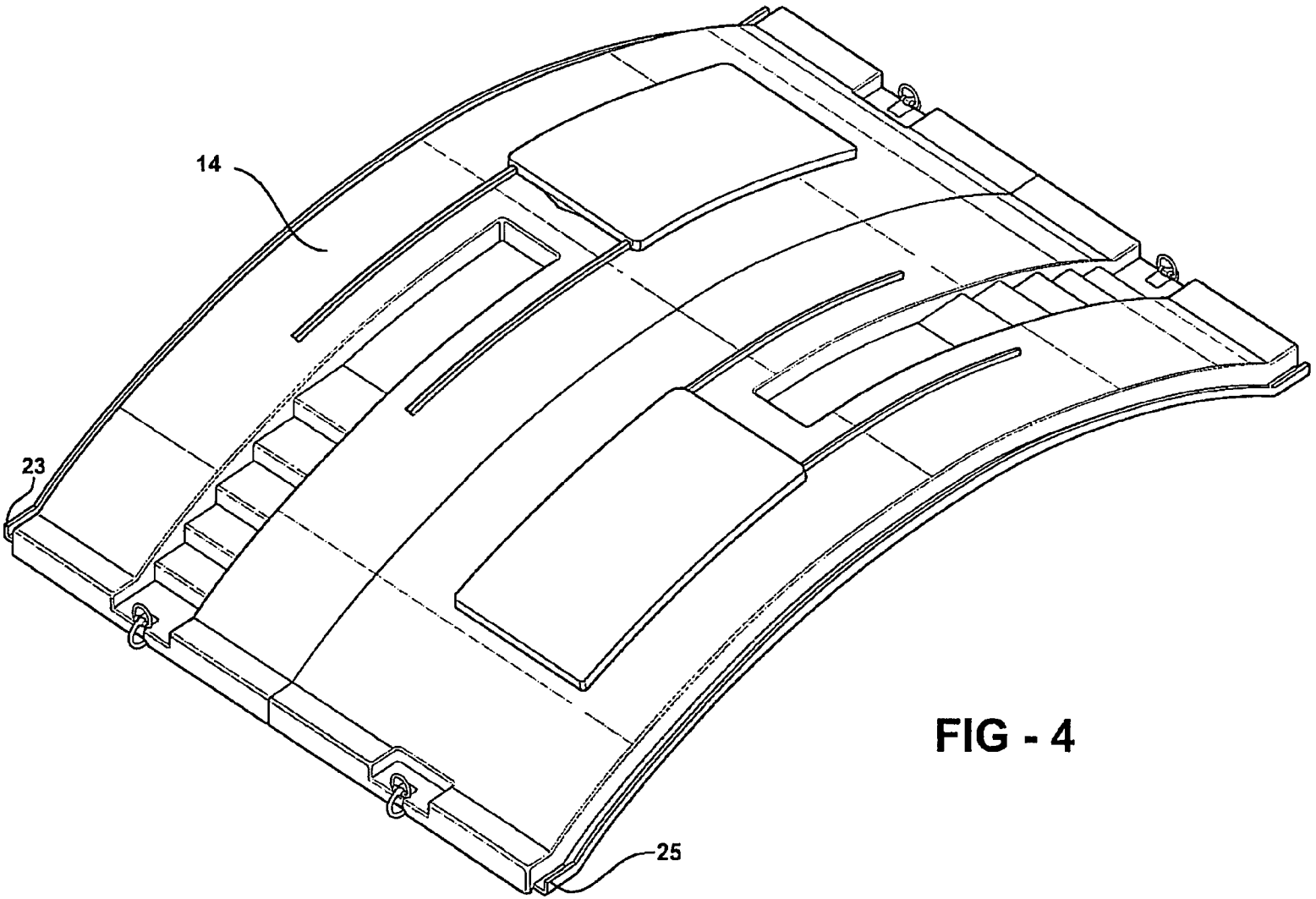
FIG. 4 is a rotated perspective view of a selected female lid section of the assembleable cover illustrated in FIG. 1.

FIG. 3 is a rotated perspective view of a selected male lid section, again at 12, of the assembleable cover illustrated in FIG. 1 and which includes substantially all of the identical components (not repetitively recited) associated with the end cover of FIG. 2, and with the exception of the end wall enclosure portions. Likewise, FIG. 4 correspondingly presents a rotated perspective view of selected female cover/lid section 14, this again including each of the features likewise associated with the male cover section of FIG. 3 and the end cover section of FIG. 2.

Figure 9:
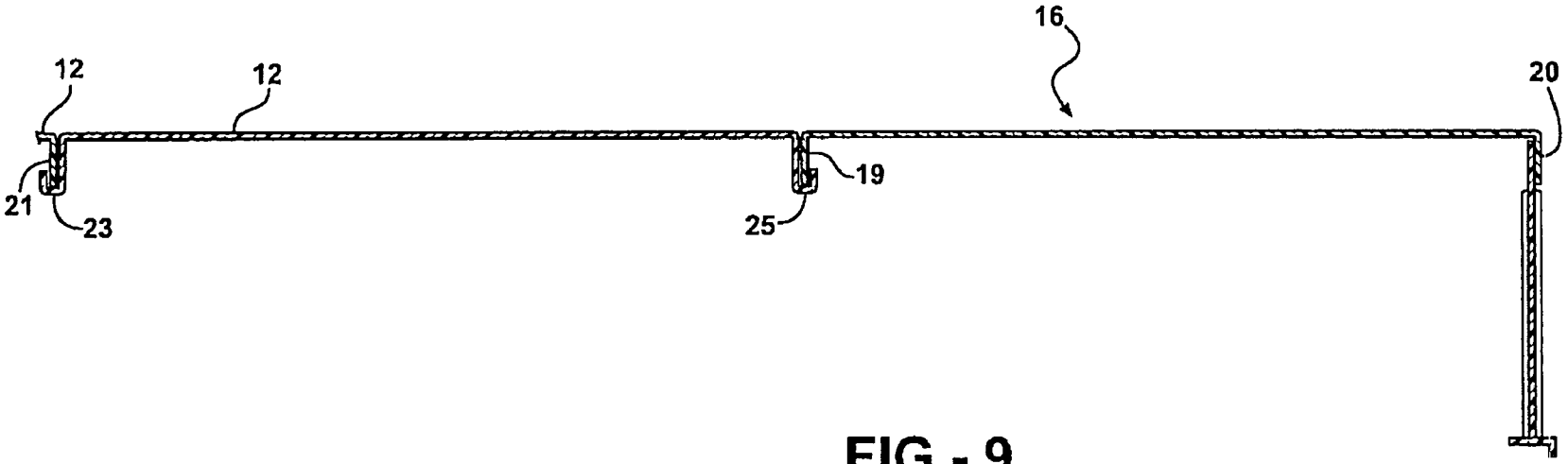
FIG. 9 is a diagrammatic view illustrating a female/end joint defined between female and end cover sections.

The male cover section 12 of FIG. 3 further includes widthwise extending and downwardly angled edges, along opposite edges and such as is shown at 21. The female cover section 14 of FIG. 4 likewise includes widthwise extending and upwardly extending edges, see at 23 and 25, and which interengage the associated angled edges 21 of the alternately engaged male sections. As further best shown in FIG. 9, the opposing widthwise extending edge 19 of the end cover section 16 is configured similar to that exhibited by the extending edge 21 associated with the male section 12 and seats within the female extending edge 25, and in similar fashion as the male section edge 21 seating within the other female extending edge 23. Referring again to FIG. 9, also illustrated is the manner in which underside widthwise direction extending and abutting joints are configured between both the male 12 and female 14 cover sections, as well as correspondingly the female 14 to end 16 cover sections. The respective length dimensions (in the illustrated embodiment 19') and maximum height (59") of the cover sections is also referenced, and according to one preferred and non-limiting embodiment.

Referring again to FIGS. 1 and 2, the assembled end cover section 16 is again shown, including the features of the first and second slidable doors 30 and 32, as well as showing an end secured ladder 38 providing access to an arcuate top surface of the end cover section. FIG. 6 is a further rotated perspective view of the end cover portion shown in FIG. 5 and both of these figures illustrate in additional detail the integrally formed pairs of tracks 31 and 33 (see FIG. 2) which cooperatively engage with the end cover section doors 30 and 32 in order to facilitate their translation between opened and closed positions.

Figure 5:
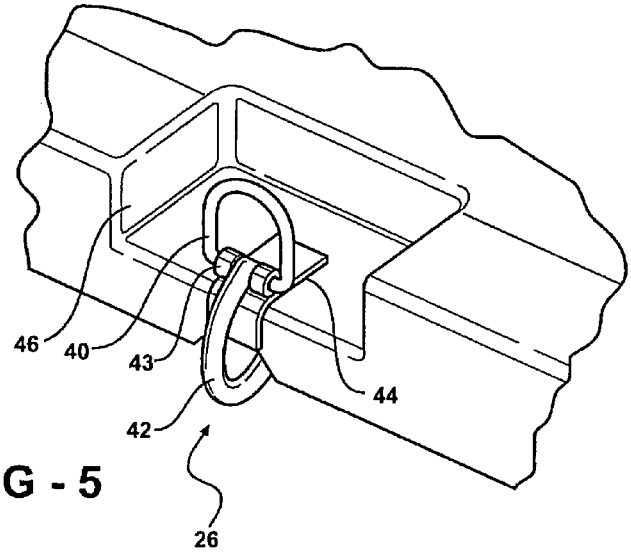
FIG. 5 is an enlarged sectional view better illustrating the lifting eye components associated with the four designated edge locations of the selected cover section.
Figure 6:
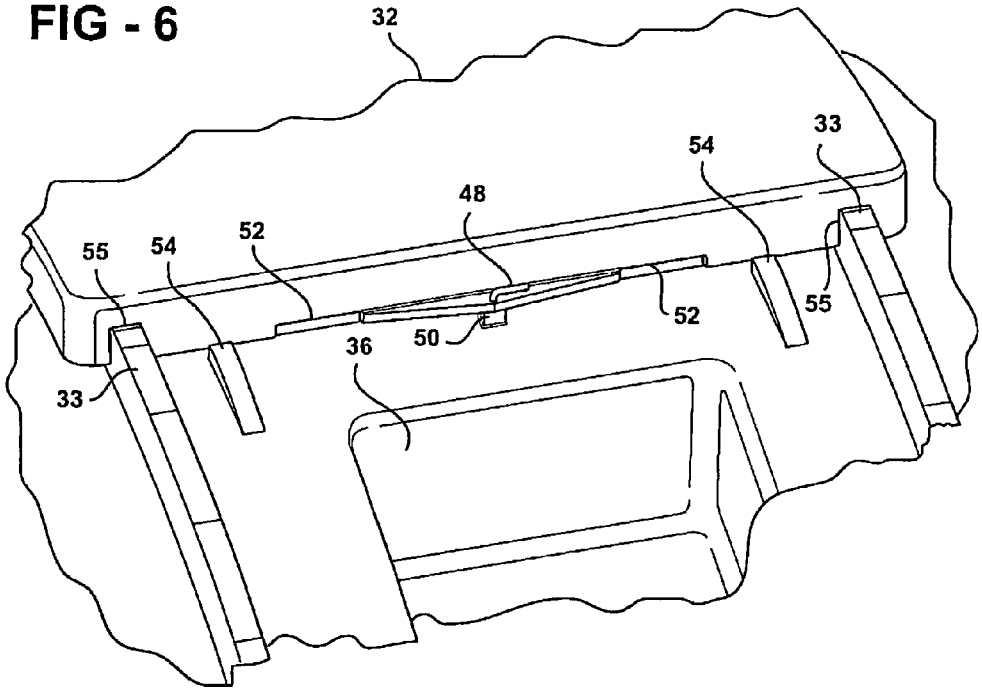
FIG. 6 illustrates an enlarged sectional view of a locking pin engaged with a cover section in a door closed condition.

FIG. 5 presents an enlarged sectional view of FIG. 6, and specifically which better illustrates the lifting eye components, generally recited at 26 in the example shown, and which is again associated with the four designated edge locations of the selected cover section. Specifically, each of the side disposed lifting eyes 26 and 28 includes a first ring portion, see at 40 which receives a hook (not shown) of an associated crane.

A substantially "C" shaped and arcuately configured locking pin 42 is also provided and which is likewise rotatable about a pivot portion 43 of an associated bracket 44, to which both the first crane engaging ring portion 40 and arcuately configured locking pin 42 are secured in collinear pivotal fashion. The bracket 44 is built (or otherwise mechanically secured) into a reinforcing side edge disposed portion, shown as recessed edge location at 46, such again including such as a heavy duty plasticized material or, in this particular instance, further potentially comprising a metal bracket or other portion integrally formed with the plasticized or PIM (powder impression molded) body.

Addressing again FIG. 6, the enlarged sectional view shown of a selected roller supported door 32 further illustrates a locking pin 48 which may be engaged with a cover section location (see underlying mounting location 50) and in order to maintain the door 32 in a closed position. As previously illustrated, the door exhibits a specified four sided (e.g. rectangular or square) configuration and includes an arcuate lengthwise direction.

Additional features include a pair of gripping locations (or hand pulls) 52 are defined in recess formed fashion along a side edge of the roller door 32 facing the integrally formed stairway 36 and which, upon removing the locking pin 48 and raising the door 32 a minor degree in order to clear a pair of spaced apart abutments 54, the door may be translated along the tracks 33, by virtue of opposing underside disposed passageways 55 defined in the door edge. A more detailed explanation of the roller supported doors (e.g. at 30 and 32) will be briefly provided with the subsequent description of FIG. 8.

Referring again to FIG. 7, illustrated is one-half section 24 of the end wall enclosing portion, also shown in FIGS. 1 and 2. The sections 22 and 24 are substantial mirror images of each other and, as to the section 24 illustrated in FIG. 7, the same includes a bottom "L" channel, see at 56, which is supportable upon the corresponding upwardly facing lip edge of the barge or other cargo carrying enclosure. A mid-point extending and vertical edge 58 (hidden behind the ladder 38 in FIG. 2) provides mating engagement with the other end section 22 (not shown in this embodiment) and an arcuate upper edge 60 follows the underside contour of the end cover 16, thereby sealing off the interior cargo. Vertically extending strengthening ridges, see at 61, are provided for increasing the structural rigidity of the end sections 22 and 24 along the adjoining mounting locations with the edge 20 of the end cover section 16 (see FIG. 1).

Figure 8:
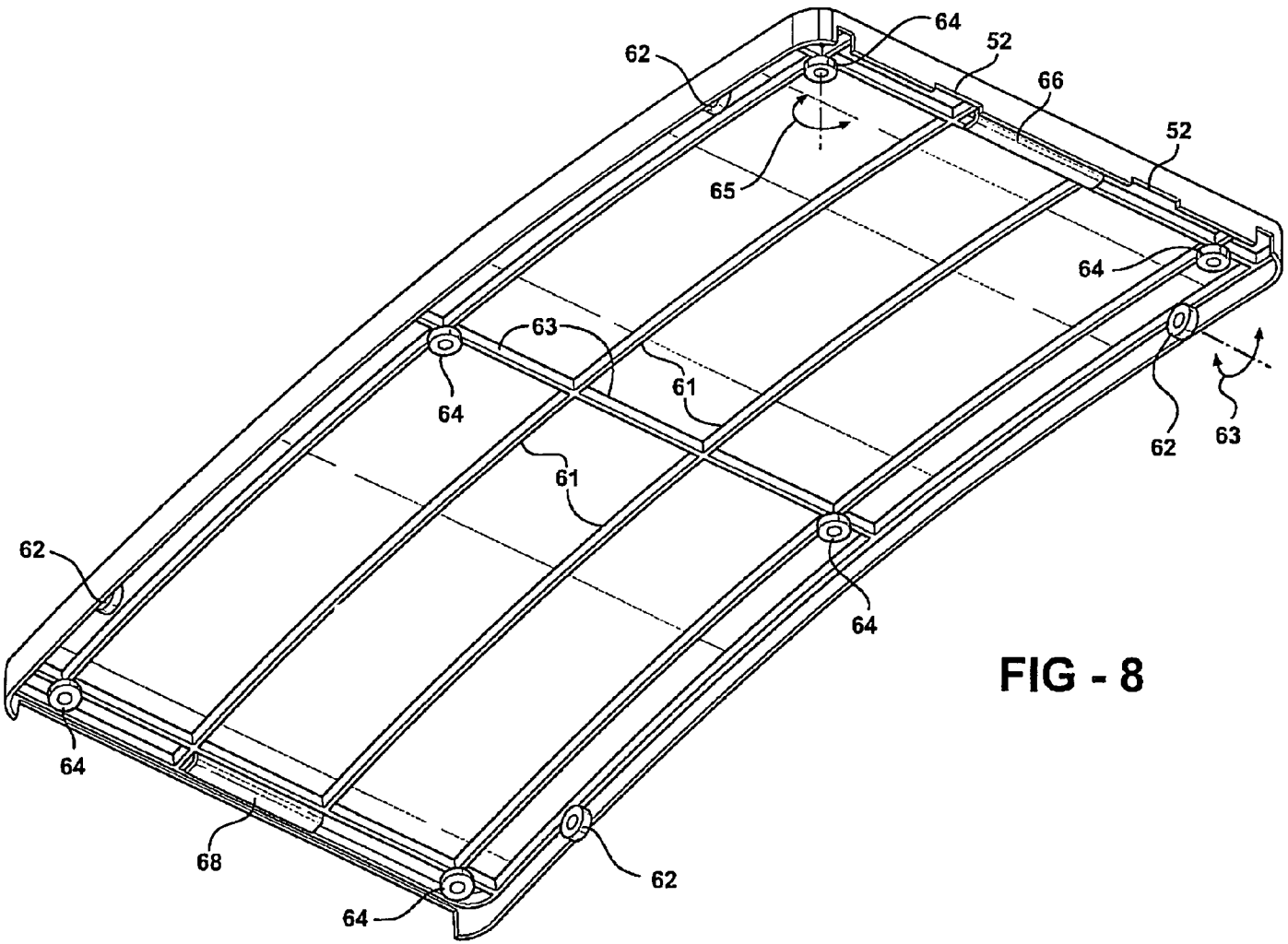
FIG. 8 is an upper perspective view of a roller supported door and illustrating such features as underside situated rollers and end configured hand pull locations.

FIG. 8 is a rotated underside perspective view of a selected roller supported door, such as previously shown at 30 or 32. The arcuate configuration of the door 32, such as also shown in FIG. 6, corresponds to the widthwise extending contour associated with each of the male, female and end cover sections.

The door 32 includes a first plurality of door rollers 62, these being arranged to rotate about horizontal axes (see at 63) for supporting the door 32 upon the exterior facing surfaces of the associated cover section, and such that the rollers 62 are disposed outboard of the associated tracks 33 (see again FIGS. 2 and 6) and aligning underside disposed passageways 55 (FIG. 6). In cooperation, and referring again to FIG. 8, a further plurality of track rollers 64 are provided, these disposed to rotate about vertical axes 65, and for supporting the door 32 against lateral shifting/misalignment between opened and closed configurations.

The underside view of FIG. 8 further illustrates in greater detail the structural framework, note lattice-type lengthwise 61 and cross 63 members, associated with the door construction. As with the cover sections, the doors 30 and 32 are also typically constructed of a durable plastic or PIM material. A pair of end positioned engagement locks 66 and 68 are shown in FIG. 8 at opposite underside edge/end locations of the door 32, the underside configured locks 67 engaging with the mounting locations 50 (see again FIG. 6) and, in combination with the engagement pin 48, selectively lock the door in an open or closed position at either traversable end of the pairs of tracks 31 and 33.

The front locking portion, again at 66, secures the door in a selected traversed position. In particular, the inwardly "L" shape of the front lock 66, as viewed in FIG. 12, biases against an inwardly facing edge (not shown but again understood to include such as a portion associated with or positioned closely adjacent to the mounting location previously shown at 50) associated with the cover and contiguous with the cargo opening. The opposite edge again shows a lower locking portion 68 arranged along an opposite end of the door. The lower locking portion 68 is similar in configuration with the front locking portion 66, and such that its "L" shaped and widthwise extending profile extends in a similar direction so as to abut an opposite open inward perimeter defining edge of the cargo opening to abut the door in its closed position.

Figure 13:
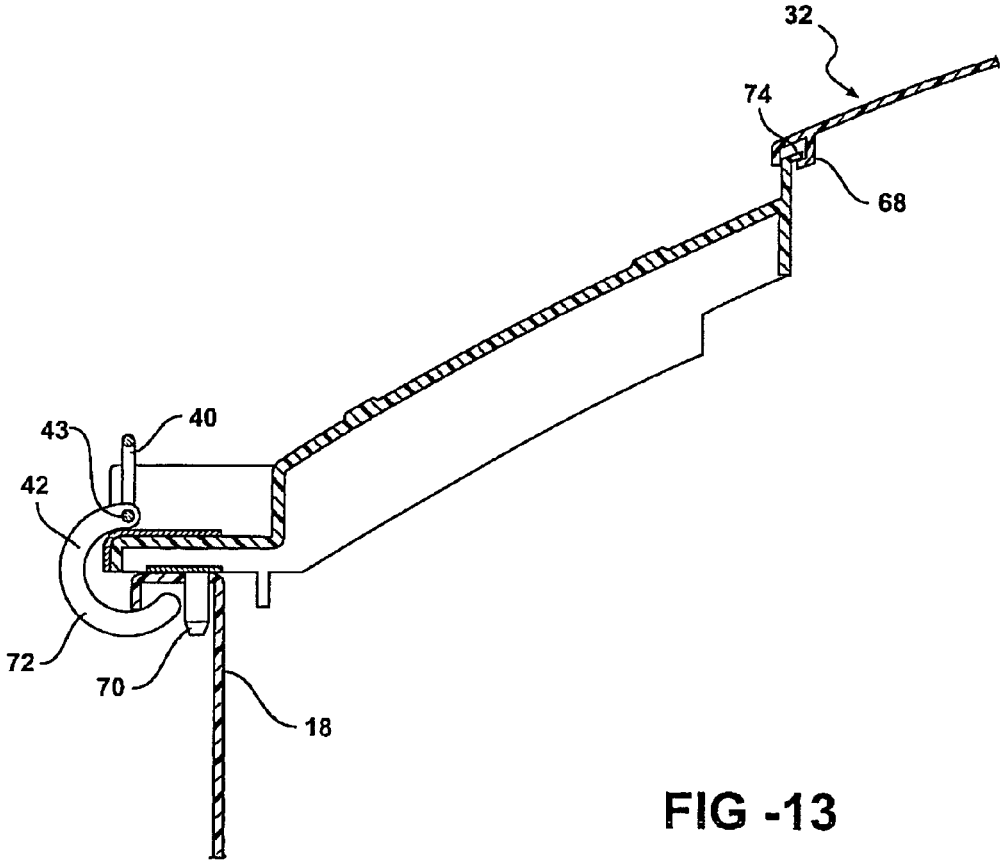
FIG. 13 is an enlarged cutaway view of an interconnecting side wall location established between a selected cover section and an associated lip edge of a transport barge.

FIG. 13 further presents an enlarged line art view of an interconnecting sidewall location established between a selected cover section and an associated lip edge of a transport barge. Specifically, the features of the arcuate "C" shaped locking pin 42 are shown in cooperation with a locating pin 70 seating through an aperture defined in an upwardly terminating lip edge 72 associated with the barge 18. Engagement of the pin 42, by it pivoting about its portion 43, against the lip edge 72 and in combination with the locating pin 70, serves to secure the sidewall location. Reverse rotation of the arcuate pin 42, away from the lip edge 72, precedes a hook and line (not shown) engaging the first ring 40 and, in combination with all of the lifting points referenced at 26 and 28, facilitating the lifting of the selected cover section. Also shown at 74 in FIG. 15 is the adjoining perimeter defining edge 74 which abuts the lower locking portion 68 in order to maintain the door 32 in the closed position.

Figure 10:
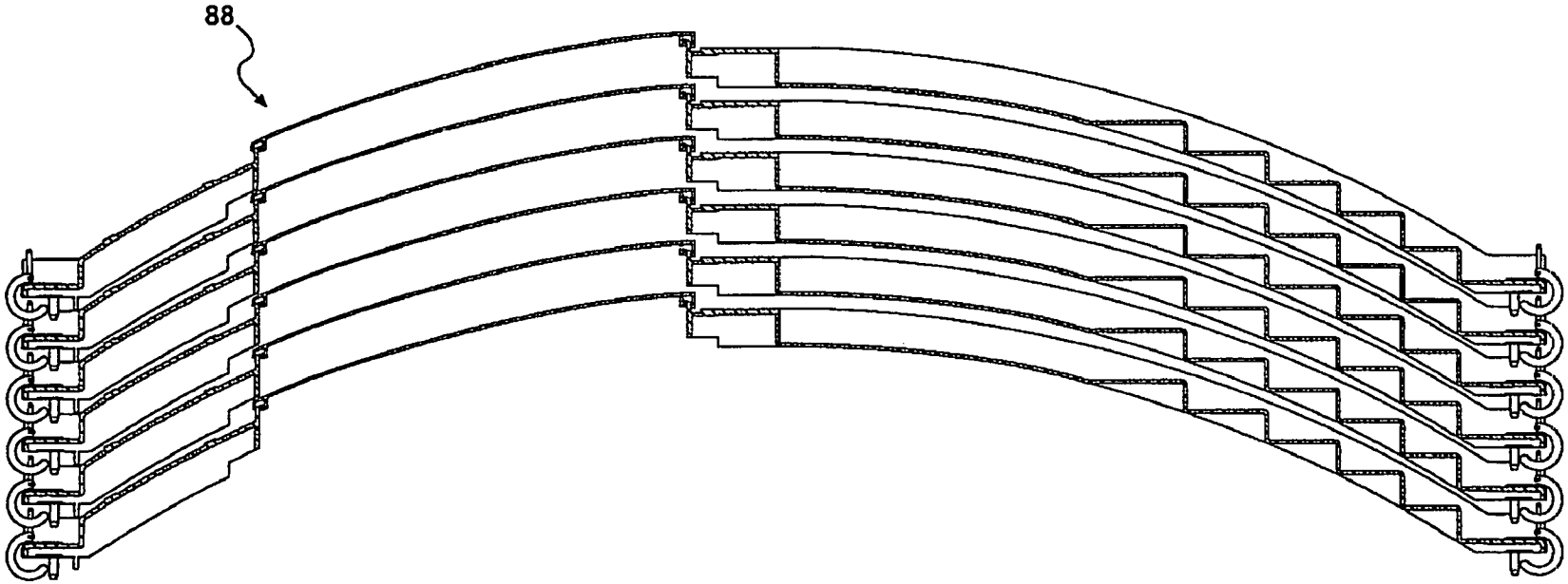
FIG. 10 is an illustration of a plurality of cover sections arranged in multiple stacked fashion.
Figure 12:
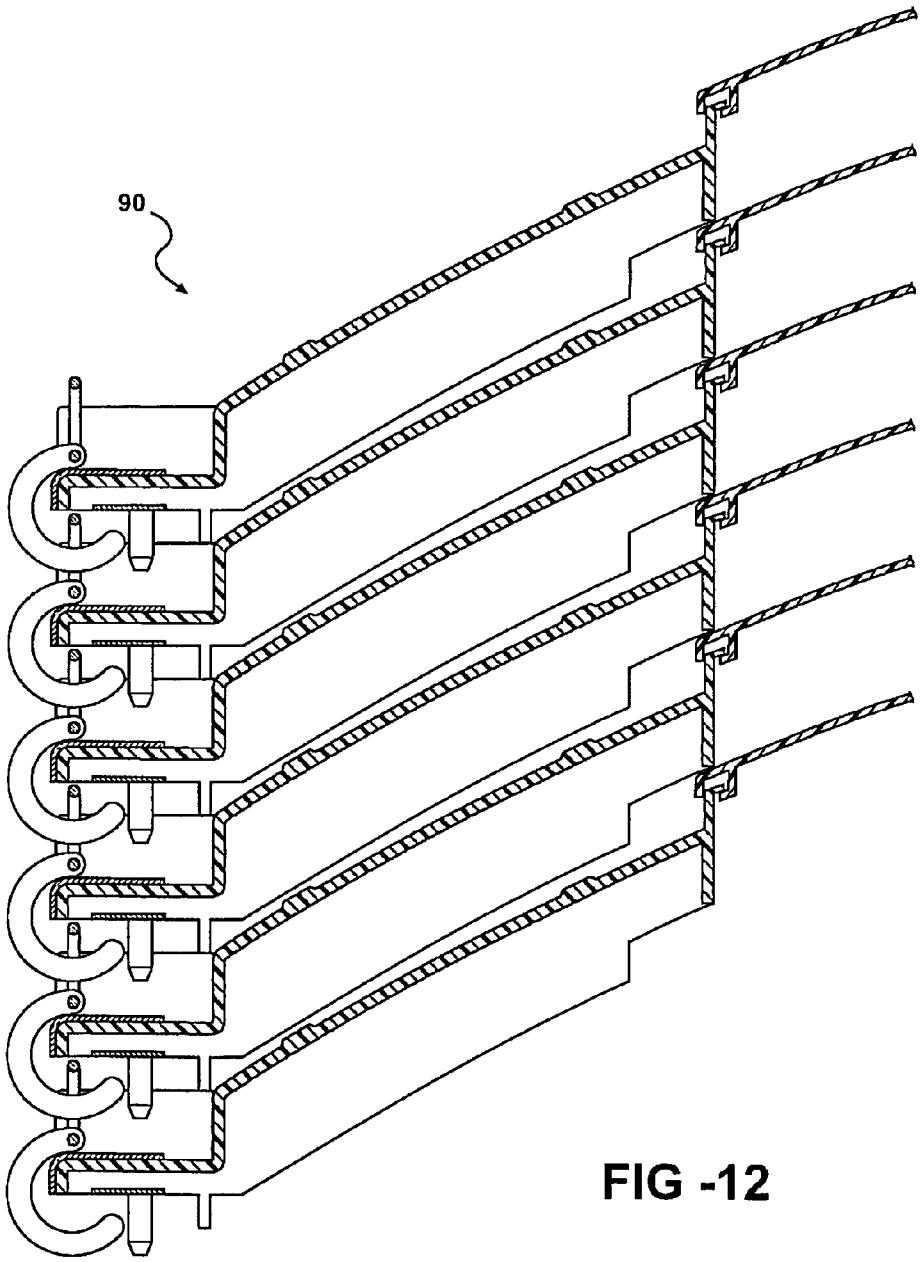
FIG. 12 is an enlarged sectional of the view of FIG. 10 and more clearly illustrating the overlapping and stackable relationship established between the cover sections.

Referring now to FIG. 10, an illustration is generally shown at 88 shown of a plurality of cover sections arranged in multiple stacked fashion. As previously described, a feature of the present inventions is the ability to stack a plurality of the buoyant and lightweight cover sections (any combination of male, female or end), such as which are then easy to transport or store according to the wishes of the user. FIG. 12 is an enlarged sectional 90 of the cutaway view 88 of FIG. 10 and more clearly illustrating the overlapping and notable/stackable relationship established between the cover sections.

Figure 11:
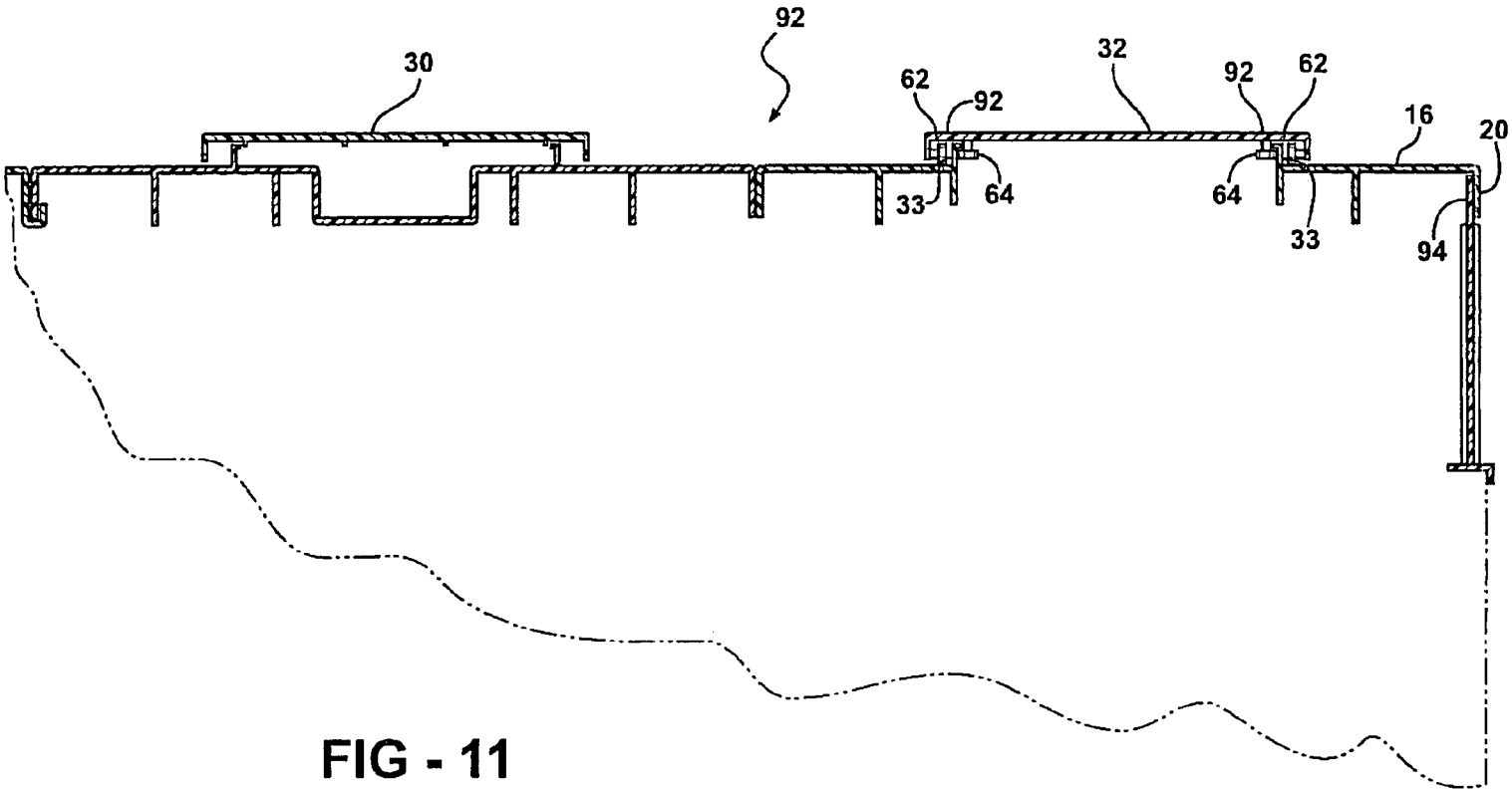
FIG. 11 is a line art lengthwise cutaway view illustrating a selected pair of doors associated with an end cover section, the doors illustrated in respective opened and closed configurations.

FIG. 11 is a line art lengthwise cutaway view, at 92, illustrating a selected pair of doors 30 & 32, such as associated with an end cover section, and by which the doors are illustrated in respective opened and closed configurations. FIG. 11 illustrates the closed door in greater detail, such as with the sets of door 62 and track 64 rollers (also shown in FIG. 8) abutting widthwise extending locations associated with the edge defined tracks 33 and additional underside extending lip edges 92 associated with the cover surface and for engaging outward disposed surfaces of the track rollers 64 and in order to prevent lateral misalignment of the door during opening and closing traversing motion. Also shown at 94 is the manner in which the cover edge 20 is sealed and bolted to the end wall joint 20 (also FIG. 2) and in order to render a watertight seal to the cover construction.

As further referenced joints within the covers may be sealed and bolted and it is further again understood that appropriate (anti-moisture admitting) ventilation is provided with respect to some or all of the cover sections in order to maintain the integrity of the contents associated with the barge. As further illustrated throughout the various drawings, the exterior surfaces of each of the male/female/end cover sections exhibit roughened (anti-slid) exterior surfaces, such as shown at 96 with reference to end section 16 in FIGS. 1 and 2, these for the purpose of providing a slip resistant surface during such as the assembly/locking of the individual cover sections, as well as walking along a top of the cover sections and opening and closing of the roller supported doors.

Having described my invention, other and additional preferred embodiments will become apparent to those skilled in the art to which it pertains, without deviating from the scope of the appended claims:

I claim:

1. A cover for use with an elongated and inner perimeter defining opening associated with a transportable barge, said cover comprising:

a body constructed from a plurality of assembleable cover sections extending in both widthwise and lengthwise fashion relative to an edge defining the open perimeter of the barge, said plurality of cover sections including first and second end sections and intermediately defined and alternating female and male sections arranged in joint abutting fashion, said male cover sections each exhibiting widthwise and downwardly extending edges along each of opposite ends, alternating female cover sections each exhibiting widthwise and downwardly extending edges which terminate in upward angled portions for locating and engaging said male extending edges, said cover exhibiting a lightweight plasticized construction;

opposing pairs of lifting eyes and locking pins being defined along side edge extending locations of said cover section and adapted to securing said cover section upon the barge perimeter defining edge; and at least one door incorporated into said cover section and creating an opening for accessing a cargo carrying interior associated with said barge.

2. The cover as described in claim 1, further comprising lightweight and plasticized end walls associated with each end section and which are sealed and bolted to associated end wall joints.

3. The cover as described in claim 2, further comprising a ladder secured in vertically extending fashion along a selected end wall section.

4. The cover as described in claim 1, each of said cover sections exhibiting a specified shape and size with an arcuate extending upper edge into which is integrally formed a stairway leading to said door.

5. The cover as described in claim 4, each of said cover sections further comprising a pair of roller supported doors and integrally defined stairways extending in opposing and lengthwise spaced apart fashion from first and second sides.

6. The cover as described in claim 5, each of said roller supported doors further comprising a substantially rectangular and four-sided configuration with an arcuate extending width.

7. The cover as described in claim 6, each of said doors further comprising respective pluralities of door supporting and track supporting rollers, mating grooves and ridges established between the door and cover section facilitate displacement of the door between opened and closed positions and both front and rear locking portions associated with the door facilitate supporting the door in the opened and closed positions.

8. The cover as described in claim 1, each of said cover sections exhibiting a specified shape and size and including exterior textured and skid-proof surfaces.

9. The cover as described in claim 1, each of said cover sections exhibiting a specified shape and size and adaptable to being stacked in multiple fashion.

10. A cover for use with an elongated opening associated with a transportable barge, said cover comprising:

a plurality of cover sections, each extending in both widthwise and lengthwise fashion relative to an upper lip edge defining an open perimeter of the barge, said cover sections further exhibiting a lightweight plasticized construction;

said plurality of cover sections further including first and second end sections and intermediately defined and alternating female and male sections arranged in joint abutting fashion between opposite ends of the barge perimeter opening, lightweight and plasticized end walls associated with each end section and which are sealed and bolted to associated end wall joints;

said end walls each further comprising first and second semi-sections which are minor images of each other, each semi-section including a bottom L-shaped channel which is supportable upon the corresponding upwardly facing lip edge of the barge, a mid-point extending and vertical edge providing mating engagement with the other semi-section section, and an arcuate upper edge following an underside contour of said end cover, thereby sealing off the interior cargo;

opposing pairs of lifting eyes and locking pins being defined along side edge extending locations of said cover section and adapted to securing said cover section upon the barge perimeter defining edge;

at least one roller supported and traversable door incorporated into said cover section and for selectively defining an opening for accessing a cargo carrying interior associated with said barge; and each of said cover sections further comprising an arcuate extending upper edge into which is integrally formed a series of angled interconnecting surfaces defining a stairway leading to said door.

11. The cover as described in claim 10, said semi-sections each further comprising vertically extending strengthening ridges for increasing the structural rigidity of the end positioned semi-sections along the adjoining mounting locations with an edge of said end cover section.

12. The cover as described in claim 10, further comprising a ladder secured in vertically extending fashion along a selected end wall section.

13. The cover as described in claim 10, each of said roller supported doors further comprising a substantially rectangular and four-sided configuration with an arcuate extending width.

14. The cover as described in claim 13, each of said doors further comprising respective pluralities of door supporting and track supporting rollers, mating grooves and ridges established between the door and cover section facilitate displacement of the door between opened and closed positions and both front and rear locking portions associated with the door facilitate supporting the door in the opened and closed positions.

15. The cover as described in claim 10, each of said cover sections exhibiting a specified shape and size and including exterior textured and skid-proof surfaces.

16. The cover as described in claim 10, each of said cover sections exhibiting a specified shape and size and adaptable to being stacked in multiple fashion.

17. A cover for use with an elongated opening associated with a transportable barge, said cover comprising:

a plurality of cover sections, each extending in both widthwise and lengthwise fashion relative to an upper lip edge defining an open perimeter of the barge, said cover sections further exhibiting a lightweight plasticized construction;

said plurality of cover sections further including first and second end sections and intermediately defined and alternating female and male sections arranged in joint abutting fashion between opposite ends of the barge perimeter opening, lightweight and plasticized end walls associated with each end section and which are sealed and bolted to associated end wall joints;

said end walls each further comprising first and second semi-sections which are minor images of each other, each semi-section including a bottom L-shaped channel which is supportable upon the corresponding upwardly facing lip edge of the barge, a mid-point extending and vertical edge providing mating engagement with the other semi-section section, and an arcuate upper edge following an underside contour of said end cover, thereby sealing off the interior cargo;

opposing pairs of lifting eyes and locking pins being defined along side edge extending locations of said cover section and adapted to securing said cover section upon the barge perimeter defining edge;

at least one door incorporated into said cover section selectively defining an opening for accessing a cargo carrying interior associated with said barge; and each of said cover sections further comprising an arcuate extending upper edge into which is integrally formed a series of angled interconnecting surfaces defining a stairway leading to said door.

* * * * *